US010012382B2

(12) United States Patent
Hilber et al.

(10) Patent No.: US 10,012,382 B2
(45) Date of Patent: Jul. 3, 2018

(54) COMBUSTION SYSTEM

(71) Applicant: ALSTOM Technology Ltd, Baden (CH)

(72) Inventors: Thomas Hilber, Kernen-Stetten (DE); Bernd Greiner, Salach (DE); Hans-Peter Schommer, Althütte (DE); Noel Francon, Stuttgart (DE); Helmut Jaiser, Frickenhausen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 383 days.

(21) Appl. No.: 14/835,793

(22) Filed: Aug. 26, 2015

(65) Prior Publication Data

US 2016/0061446 A1 Mar. 3, 2016

(30) Foreign Application Priority Data

Sep. 2, 2014 (EP) ..... 14183182

(51) Int. Cl.
*F23K 3/02* (2006.01)
*F23C 6/04* (2006.01)
(Continued)

(52) U.S. Cl.
CPC ..... *F23K 3/02* (2013.01); *F23C 5/08* (2013.01); *F23C 6/047* (2013.01); *F23C 7/006* (2013.01);
(Continued)

(58) Field of Classification Search
CPC .. F23C 5/08; F23C 6/047; F23C 7/002; F23C 7/004; F23C 7/006; F23C 2201/10;
(Continued)

(56) References Cited

U.S. PATENT DOCUMENTS 4,426,939 A * 1/1984 Winship ..... F23C 5/32 110/261
4,627,366 A * 12/1986 LaRue ..... F23K 3/02 110/263

(Continued)

FOREIGN PATENT DOCUMENTS

| | | |
|---|---|---|
| DE | 2 933 528 A1 | 2/1981 |
| EP | 0 225 157 A2 | 6/1987 |
| FR | 1 352 264 A | 2/1964 |

*Primary Examiner* — David J Laux
(74) *Attorney, Agent, or Firm* — GE Global Patent Operation; Stephen G. Midgley

(57) ABSTRACT

A combustion system having a furnace defining a combustion chamber includes a first burner disposed at an upper elevation of the combustion chamber and a second burner and a third burner disposed at a lower elevation of the combustion chamber. A first duct extends vertically to convey therein a fuel flow of gas and pulverized fuel. A second duct branches from the first duct to the first burner to convey a first portion of the fuel flow, which is fuel lean, to define a fuel lean flow, wherein a second portion of the fuel flow passes through the first duct as a fuel rich flow. A third duct includes one end disposed longitudinally within the first duct. An impeller is disposed within the first duct upstream of the branching of the second duct and downstream of the one end of the third duct disposed in the first duct. The impeller includes a plurality of blades to direct outwardly the pulverized fuel of the fuel rich flow to provide a fuel reduced content flow passing through the second duct to the second burner, and a fuel concentrated content flow passing through first duct to the first burner.

18 Claims, 3 Drawing Sheets

(51) Int. Cl.
*F23C 7/00* (2006.01)
*F23C 5/08* (2006.01)

(52) U.S. Cl.
CPC .. *F23C 2201/101* (2013.01); *F23K 2203/006* (2013.01); *F23K 2203/201* (2013.01)

(58) Field of Classification Search
CPC ..... F23C 2201/101; F23K 3/02; F23K 2203/006; F23K 2203/008; F23K 2203/201
See application file for complete search history.

(56) References Cited

U.S. PATENT DOCUMENTS

| | | | | |
|---|---|---|---|---|
| 8,302,545 | B2 * | 11/2012 | Swanson | F23C 6/045 110/182.5 |
| 8,430,665 | B2 * | 4/2013 | Payne | F23C 6/047 110/203 |
| 2004/0231572 | A1 | 11/2004 | Ohtani et al. | |
| 2014/0065561 | A1 * | 3/2014 | Zhang | F23K 3/00 431/175 |

* cited by examiner

COMBUSTION SYSTEM

CROSS-REFERENCE TO RELATED APPLICATIONS

This application claims priority to EP Application No. 14183182.6 filed Sep. 2, 2014, the contents of which are hereby incorporated in its entirety.

TECHNICAL FIELD

The present invention relates to a combustion system; in particular the invention refers to a combustion system that is part of a boiler, such as a boiler of a power plant for electric power generation.

BACKGROUND

Boilers for electric power generation often have combustion systems with furnaces that are fired with solid fuel, such as coal, lignite, etc.; these combustion systems are usually provided with mills for pulverizing the fuel and ducting for supplying the pulverized fuel to burners of the furnace.

In these boilers, both fuel quality and achievable dust concentration influence operational flexibility, safe ignition, and flame stability.

In particular, in case of lignite fired boilers, fuel concentration is an important parameter to control, because of the very different features of different kinds of lignite, such that in order to maintain safe operation it is necessary to increase pulverized fuel concentration when the quality of the lignite lowers.

In order to increase fuel concentration it is common the use of the so called vapour separation systems; these systems separate the flow coming from the mill in a fuel rich flow and direct it to burners located at a lower zone of the furnace and a fuel lean flow (i.e. a vapour rich flow) and supply it to burners located at an upper zone of the furnace.

Different vapour separation systems have been proposed.

A first example of vapour separation system takes advantage of the non-homogeneous flow coming from the mill. In this case a branching in the duct that carries the flow from the mill causes separation of the flow in a fuel rich flow in one ducting and fuel lean flow in other ducting.

This vapour separation system proved to cause low pressure losses while ensuring good separation performances.

A different example of vapour separation system provides for an impeller that divides a homogeneous flow between different ducting; in particular the impeller forces separation of a fuel rich flow from a fuel lean flow and directs each flow in different ducting. For example, DE 293 35 28 discloses a vapour separation system of this kind.

This vapour separation system proved to be very effective in separation, but at the same time it causes high pressure losses.

Lignite fired boilers have to guarantee a broad operation load range but, because of the intrinsic features of the lignite, at low load (for example load below 50%, preferably 40%, more preferably 30%, and even more preferably below 20%) the fuel concentration achievable with the known vapour systems and/or the pressure losses cannot guarantee safe operation.

SUMMARY

An aspect of the invention includes providing a combustion system that is able to safely operate in a broad load range, in particular at low/very low load, without impairing or with a limited impairing of the operation at medium/high load, in particular when lignite is fired; other fuels are anyhow possible and in particular low quality fuels containing a large amount of humidity and ash.

These and further aspects are attained by providing a combustion system in accordance with the accompanying claims.

BRIEF DESCRIPTION OF THE DRAWINGS

Further characteristics and advantages will be more apparent from the description of a preferred but non-exclusive embodiment of the combustion system, illustrated by way of non-limiting example in the accompanying drawings, in which.

DETAILED DESCRIPTION

Figure 1:
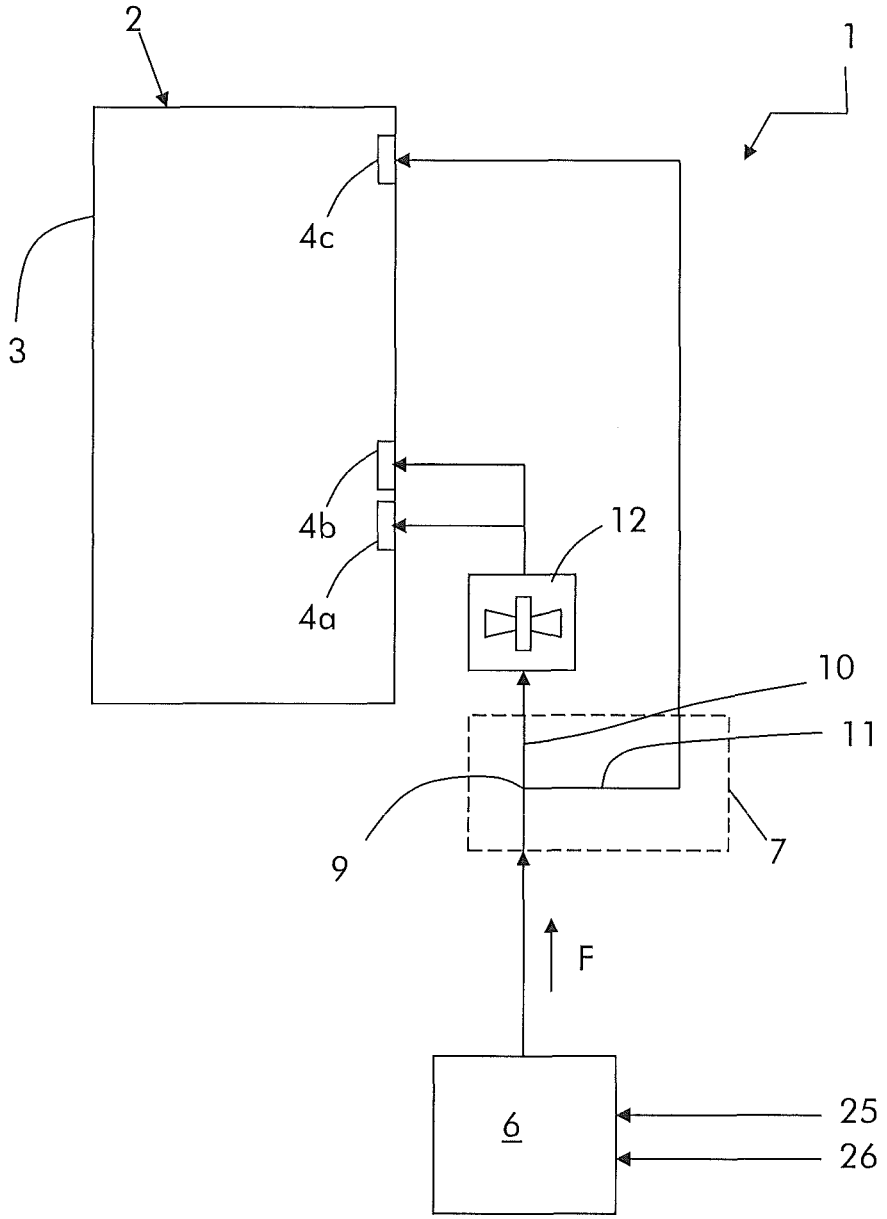
FIG. 1 schematically shows a combustion system in an embodiment of the invention.

With reference to the figures, these show a combustion system 1 comprising a furnace 2 having an enclosure 3 defining a combustion chamber; preferably the furnace 2 is part of a boiler, in this case the enclosure 3 is made of tubed walls, for a cooling medium such as water to pass through the tubed walls and evaporate.

The furnace 2 further has burners 4*a*, 4*b*, 4*c* having different elevation. The burners can be of different types known in the art; they are arranged to supply solid fuel such as lignite and/or vapour containing solid fuel; they can be all equal or they can be different from one another.

The combustion system 1 further comprises a mill 6 for milling solid fuel such as lignite to be supplied to the burners 4*a*, 4*b*, 4*c*. The mill 6 is connected to a vapour separation system 7.

The vapour separation system 7 receives a non-homogeneous flow of vapour and pulverized fuel and comprises a branching area 9 between first ducting 10 and second ducting 11; the non-homogeneous flow is divided at the branching 9 between the ducting 10 and 11 such that a fuel rich flow passes through the first ducting 10 and a fuel lean flow passes through the second ducting 11.

In addition, the first ducting 10 comprises an impeller 12 at a position downstream the branching area 9 with reference to the flow F of vapour and pulverized fuel coming from the mill 6.

The figures show an example of an impeller 12 with a body 12*a* and fixed impeller blades 12*b* extending therefrom. The flow passes through the impeller 12 such that the impeller 12 defines (through the blades 12*b*) a fuel concentrated content flow FC and a fuel reduced content flow FR.

The combustion system 1 further has ducting 15 for supplying the fuel concentrated content flow FC to first burners 4*a* of the burners having a lower elevation, and ducting 16 for supplying the fuel reduced content flow to second burners 4*b* of the burners having a lower elevation.

For example, as shown in the figures, the ducting 16 has an end inserted in the ducting 15, at an elbow thereof.

Advantageously the second burners 4*b* have a higher elevation than the first burners 4*a* and preferably the second burners 4*b* are located above the first burners 4*a*, such that the flame generated by the first burners 4*a* can contribute to maintain the flame generated by the second burners 4*b* in case of excessively lean fuel reduced content flow.

The impeller 12 can have blades 12*b* with adjustable pitch angle and, in this respect, the blades 12*b* can be connected to an electro-mechanical or hydraulic-mechanical mechanism 19.

In addition, the furnace 2 can also have a controller 20 to control the position of the blades 12*b* in accordance with a signal indicative of the load of the mill or flame stability or pulverized fuel content in the fuel concentrated content flow and/or fuel reduced content flow or other control signals.

The mill 6 provides a non-homogeneous flow F of vapour and pulverized fuel. Typically, the design of a beater wheel mill for lignite generates a non-homogeneous flow.

The operation of the combustion system is apparent from that described and illustrated and is substantially the following.

The mill 6 is supplied with solid fuel 25 such as lignite and carrier and drying gas 26, such as recirculated flue gas from the furnace 2.

At the mill 6 the lignite is milled and a flow F of vapour and pulverized fuel (lignite) moves from the mill 6 to the vapour separation system 7. This flow F is non-homogeneous, such that at the branching area 9 the fuel rich flow is separated from the fuel lean flow, because of the greater inertia of the pulverized fuel than the vapour or light fuel particles that are entrained by vapour.

The fuel lean flow is supplied to the burners 4*c* having the higher elevation and is combusted (for example without flame, but this depends on the particular conditions) in the furnace 2.

The fuel rich flow passes through the impeller 12 that imparts the fuel a swirl that in turn by centrifugal forces defines the fuel concentrated content flow FC with an annular configuration (i.e. over the walls of the pipes of the first ducting 10) and the fuel reduced content flow FR within the annular fuel concentrated content flow FC.

The fuel concentrated content flow FC is thus supplied via the ducting 15 to the burners 4*a* of the lower burners and is combusted; the fuel reduced content flow FR is supplied via the ducting 16 to the burners 4*b* of the lower burners and is also combusted.

The fuel concentrated content flow FC has a high concentration that allows safe operation of the furnace 2 and flame stability also at low load or very low load.

Figure 2:
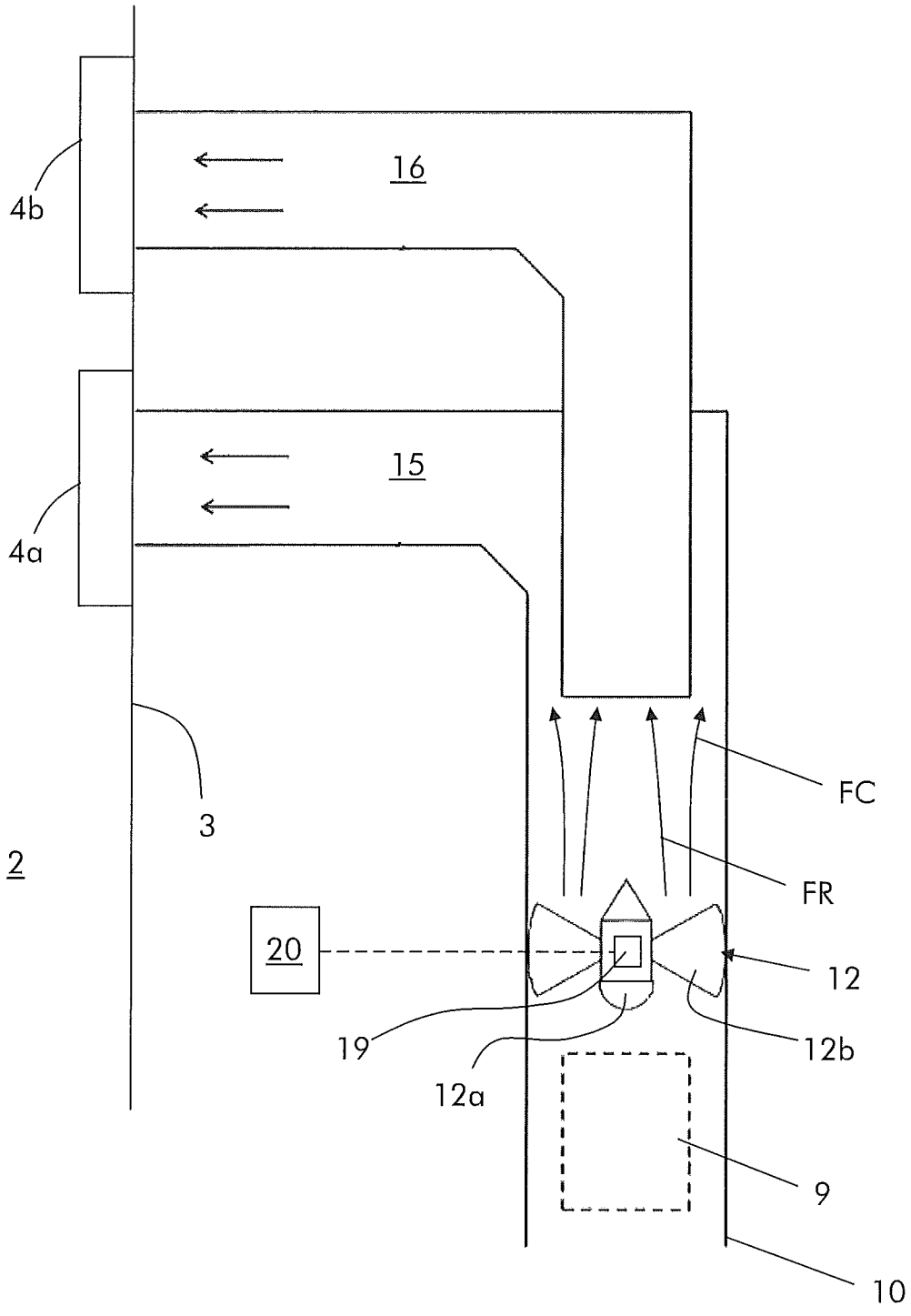
FIG. 2 schematically shows a particular of FIG. 1.

The fuel from the burners 4*b* has a lower concentration than the fuel from the burners 4*a*, but this reduced concentration does not impair the furnace operation, because the flame generated by the fuel concentrated content flow from the burner 4*a* can stabilize when needed the flame from the fuel reduced content flow from the burner 4*b*. This stabilisation effect is particularly effective when the burners 4*b* are located above the burners 4*a* as shown in FIG. 2 (i.e. vertically aligned or substantially vertically aligned).

During operation the pitch angle of the blades 12*b* of the impeller 12 can be advantageously adjusted, as indicated by reference 27. This can for example be done in accordance with a parameter such as the load of the mill or a parameter indicative thereof or other parameters.

The pitch angle is the angle between the blade cord and the impeller rotation plane; the cord is the line between leading and trailing edge.

Figure 3:
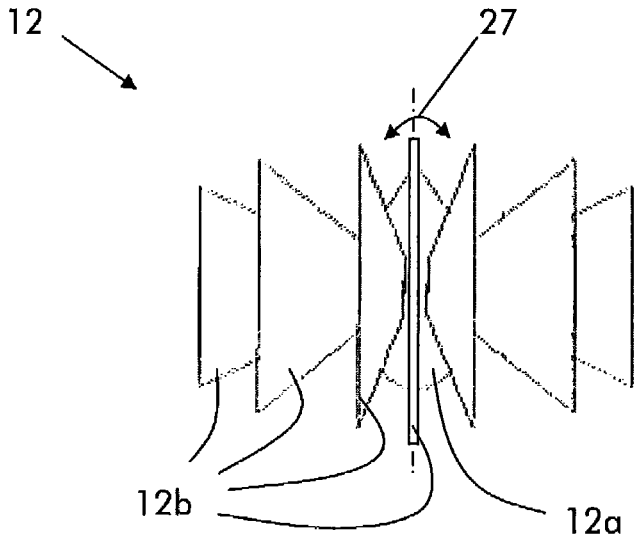
FIGS. 3 through 5 schematically show an impeller whose blades have different pitch angles.

FIG. 3 shows an example in which the pitch angle is 0. In this case the impeller 12 practically does not causes any separation between fuel concentrated content flow and fuel reduced content flow and likewise the pressure drop caused by the impeller 12 is minimum and typically negligible. This configuration can be used at medium/high load, when the vapour separation achieved at the branching area 9 is sufficient to obtain safe and stable operation of the furnace 2.

Figure 4:
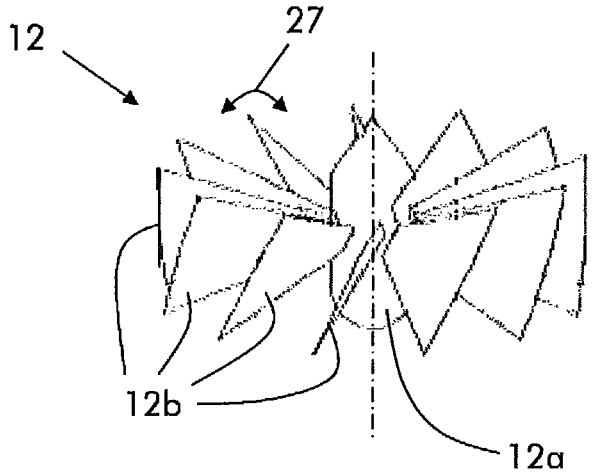

FIG. 4 shows an example in which the pitch angle is 30 degree. In this case the impeller 12 causes separation of fuel concentrated content flow FC and fuel reduced content flow FR with some pressure losses; the separation and the pressure losses are anyhow not the largest achievable, i.e. the separation can be further increased by further increasing the pitch angle but this causes more pressure drop. This configuration can be used at low/medium load.

Figure 5:
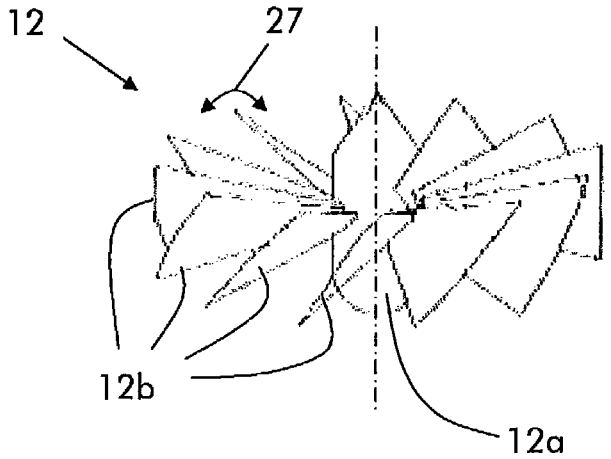

FIG. 5 shows an example in which the pitch angle is 45 degree; in this configuration the separation and the drop pressure are theoretically the largest; this configuration can be used at very low/low load.

Thus the adjustment of the pitch angle of the blades 12*b* advantageously allows to reduce the pitch angle in order to reduce pressure losses when separation of fuel concentrated content flow and fuel reduced content flow is not needed or is needed only to a limited extent to guarantee safe and stable operation of the furnace 2 and vice versa, i.e. increase the pitch angle when separation is needed to guarantee safe and stable operation of the furnace 2.

Naturally the features described may be independently provided from one another.

In practice the materials used and the dimensions can be chosen at will according to requirements and to the state of the art.

The invention claimed is:

1. A combustion system including a furnace defining a combustion chamber; the combustion system comprising:

a first burner disposed at an upper elevation of the combustion chamber;

a second burner and a third burner disposed at a lower elevation of the combustion chamber;

a first duct extending vertically to convey therein a fuel flow of gas and pulverized fuel;

a second duct branching from the first duct to the first burner to convey a first portion of the fuel flow, which is fuel lean, to define a fuel lean flow, wherein a second portion of the fuel flow passes through the first duct as a fuel rich flow;

a third duct having one end disposed longitudinally within the first duct; and an impeller disposed within the first duct downstream of the branching of the second duct and upstream of the one end of the third duct disposed in the first duct, wherein the impeller includes a plurality of blades to direct outwardly the pulverized fuel of the fuel rich flow to provide a fuel reduced content flow passing through the third duct to the second burner, and a fuel concentrated content flow passing through first duct to the third burner.

2. The combustion system of claim 1, wherein the second burner is disposed at a higher elevation of the combustion chamber than the third burner.

3. The combustion system of claim 1, wherein a pitch of the blades of the impeller are adjustable.

4. The combustion system of claim 3, further comprising an electro-mechanical or hydraulic-mechanical mechanism to adjust the pitch of the blades.

5. The combustion system of claim 3, further comprising a controller to control the pitch of the blades in accordance with a signal indicative of the load of the mill or flame stability or pulverized fuel content in the fuel concentrated content flow and/or fuel reduced content flow.

6. The combustion system of claim 1, wherein the fuel flow is a non-homogeneous flow of gas and pulverized fuel.

7. The combustion system of claim 1, wherein the combustion system is a boiler.

8. The combustion system of claim 1, wherein the gas is flue gas exiting the combustion chamber.

9. The combustion system of claim 1, wherein each of the first, second and third burners includes a plurality of burners.

10. A method of operating a combustion system including a furnace defining a combustion chamber; the method comprising:

providing a first burner disposed at an upper elevation of the combustion chamber;

providing a second burner and a third burner disposed at a lower elevation of the combustion chamber;

providing a first duct extending vertically to convey therein a fuel flow of gas and pulverized fuel;

providing a second duct branching from the first duct to the first burner;

separating the fuel flow into a first portion of the fuel flow, which is fuel lean, to define a fuel lean flow and a second portion of the fuel flow, which is fuel rich, to define a fuel rich flow;

passing the fuel rich flow through the first duct;

passing fuel lean flow through the second duct;

providing a third duct having one end disposed longitudinally within the first duct;

providing an impeller disposed within the first duct downstream of the branching of the second duct and upstream of the one end of the third duct disposed in the first duct, wherein the impeller includes a plurality of blades;

passing the fuel rich flow through the impeller wherein the blades of the impeller to direct outwardly the pulverized fuel of the fuel rich flow to provide a fuel reduced content flow passing through the third duct to the second burner, and a fuel concentrated content flow passing through first duct to the third burner.

11. The method of claim 10, wherein the second burner is disposed at a higher elevation of the combustion chamber than the third burner.

12. The method of claim 10, further comprising adjusting a pitch of the blades of the impeller.

13. The method of claim 12, wherein the adjusting of the blades is performed by an electro-mechanical or hydraulic-mechanical mechanism to adjust the pitch of the blades.

14. The method of claim 12, wherein the adjusting of the blades is performed dependent on the load of the mill or flame stability or pulverized fuel content in the fuel concentrated content flow and/or fuel reduced content flow.

15. The method of claim 10, wherein the fuel flow is a non-homogeneous flow of gas and pulverized fuel.

16. The method of claim 10, wherein the combustion system is a boiler.

17. The method of claim 10, wherein the gas is flue gas exiting the combustion chamber.

18. The method of claim 10, wherein each of the first, second and third burners includes a plurality of burners.

* * * * *